United States Patent [19]

Lindstrand

[11] 4,166,311

[45] Sep. 4, 1979

[54] APPARATUS FOR TRIMMING A CABLE TERMINAL LUG AND ASSEMBLING A FASTENER BOLT THEREON

[75] Inventor: Douglas K. Lindstrand, Elburn, Ill.

[73] Assignee: Belden Corporation, Geneva, Ill.

[21] Appl. No.: 903,507

[22] Filed: May 8, 1978

[51] Int. Cl.[2] ..... H01R 43/00

[52] U.S. Cl. ..... 29/33 A; 10/155 R; 29/33 M; 29/241; 29/564.7

[58] Field of Search ..... 29/564.1, 566.1, 33 A, 29/241, 33 M, 564.7, 33 K; 339/230 R; 10/155 R

[56] References Cited

U.S. PATENT DOCUMENTS

| | | | |
|---|---|---|---|
| 970,669 | 9/1910 | Vallone | 29/564.1 |
| 2,943,335 | 7/1960 | Daniel et al. | 10/155 R |
| 3,020,623 | 2/1962 | Beall | 29/33 N X |
| 3,368,431 | 2/1968 | Kulaga | 10/155 R X |

FOREIGN PATENT DOCUMENTS

| | | | |
|---|---|---|---|
| 506558 | 11/1951 | Belgium | 10/155 R |

*Primary Examiner*—William R. Briggs

*Attorney, Agent, or Firm*—Fitch, Even & Tabin

[57] ABSTRACT

Apparatus is disclosed for trimming a cable terminal lug to a predetermined size, inserting a bolt through a bore in the lug and assembling a nut onto the bolt in a single operating cycle. The apparatus includes means for moving a terminal lug from a first station to a second station during which the lug is trimmed, and means disposed at the second station for inserting a bolt through a bore in the lug and running a nut onto the threaded end of the bolt to a predetermined torque.

11 Claims, 9 Drawing Figures

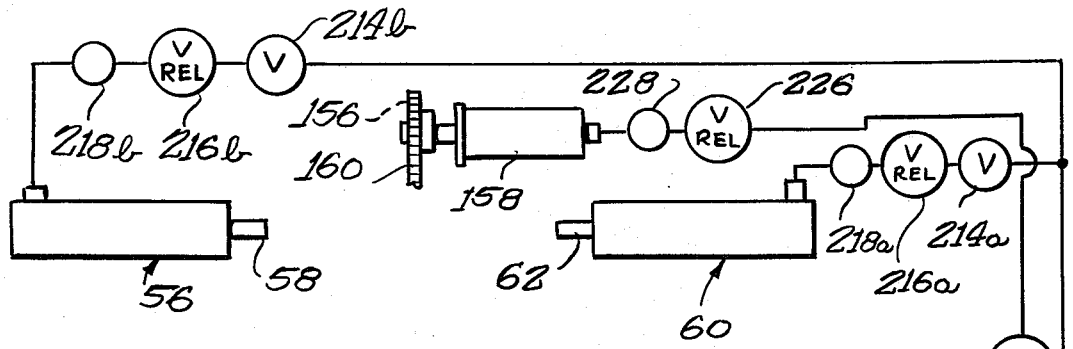
Fig. 8.
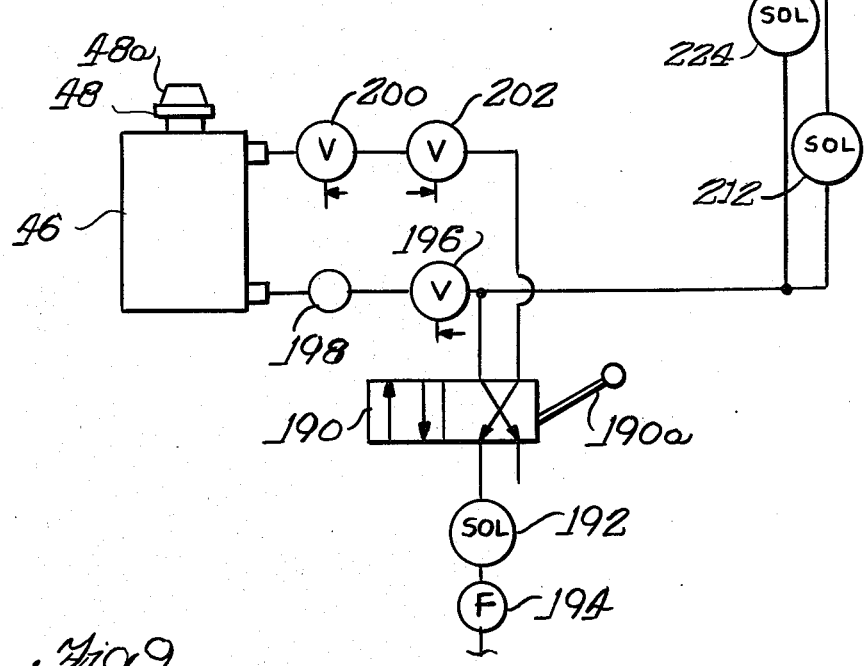
Fig. 9.
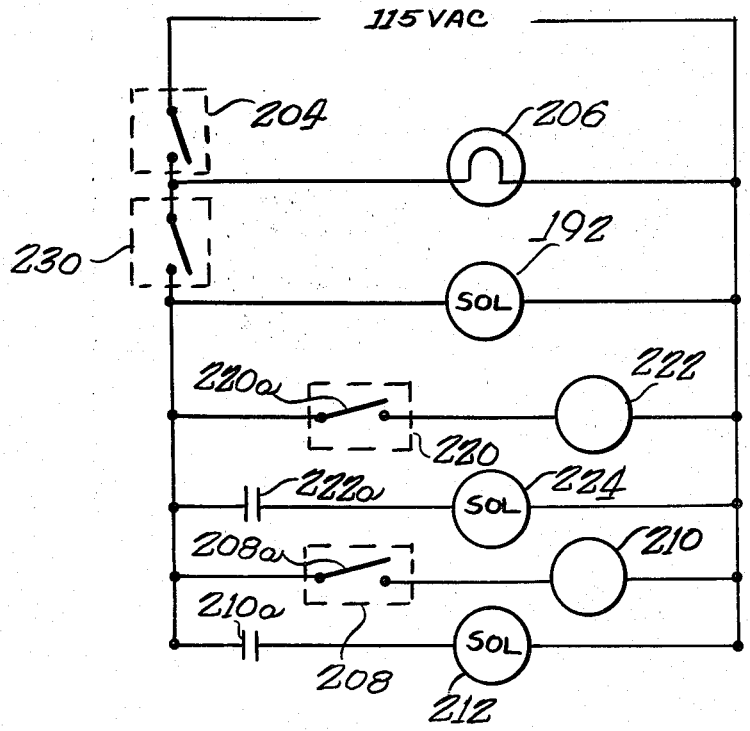

APPARATUS FOR TRIMMING A CABLE TERMINAL LUG AND ASSEMBLING A FASTENER BOLT THEREON

The present invention relates generally to apparatus for use in the manufacture of cable terminal lugs, and more particularly to novel apparatus for trimming cable terminal lug, inserting a bolt through a bore in the lug and assembling a nut on the bolt during a single operating cycle.

It is a conventional practice in electrical cable constructions, such as in battery cables and the like, to apply a terminal lug on at least one end of the cable to facilitate connection of the cable to a battery post or the like. The terminal lugs are generally bifurcated and have a first bore adapted to receive a battery post therethrough, and a second bore extending through the bifurcated end of the terminal lug generally transverse to the first bore, the second bore serving to receive a bolt therethrough upon which a nut is assembled to facilitate clamping of the terminal lug on the post.

Such terminal lugs are conventionally die-cast on the end of electrical cables and may additionally be firmly crimped onto the exposed electrical cable to insure both mechanical and electrical connection. In die casting a terminal lug on a cable, a flashing or fin-like projection may be formed on the terminal lug at the interface or parting plane of the die mold sections. The fin-like projections must be removed from the terminal lugs to prevent injury to an operator when handling and applying the terminal lugs to battery posts or the like.

In accordance with presently known techniques, the fin-like projections formed on terminal lugs are removed during one operation, and a fastener bolt and associated nut are assembled within the bolt bore through the lug in a second operation. Such two-stage production methods necessarily result in substantially greater production costs than can be realized by trimming a terminal lug and assembling a bolt and nut thereon in a single operating cycle.

One of the primary objects of the present invention is to provide novel apparatus for use in the manufacture of cable terminal lugs which provides significant economic advantages over known machines and techniques.

A more particular object of the present invention is to provide novel apparatus for the manufacture of cable terminal lugs, which apparatus is adapted to effect trimming of flash and objectionable fins formed on the terminal lugs and also insert a bolt through a bore in the terminal lug and apply a nut thereon to a predetermined torque in a single continuous operation.

A feature of the apparatus of the present invention lies in the provision of a trim die through which a cable terminal lug is passed during transfer from first to second operating stations of the apparatus, and means for inserting a bolt through a bore in the terminal lug and assembling a nut onto the bolt, the various functions of the apparatus being operable in semi-automatic relation.

Further objects and advantages of the present invention, together with the organization and manner of operation thereof, will become apparent from the following detailed description of the invention when taken in conjunction with the accompanying drawings wherein like reference numerals designate like elements throughout the several views, and wherein:

FIG. 8 is a diagrammatic view of a pneumatic control circuit for use with the apparatus of FIG. 1; and FIG. 9 is a schematic diagram of an electrical circuit for use with the apparatus of FIG. 1.

Figure 1:
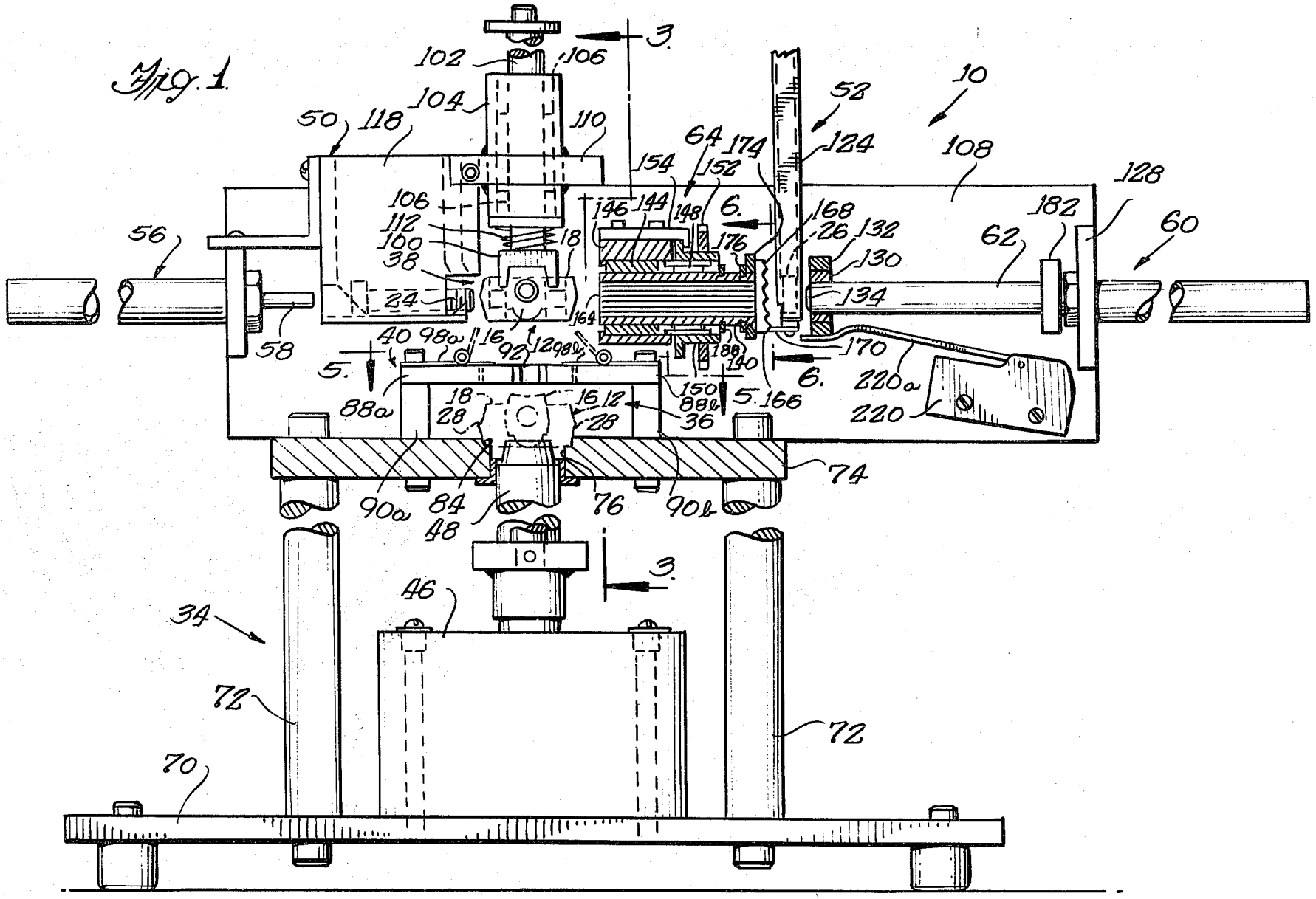
FIG. 1 is a front elevational view, taken partly in section, illustrating an apparatus for trimming a cable terminal, inserting a bolt therethrough and assembling a nut onto the bolt in accordance with the present invention.
Figure 2:
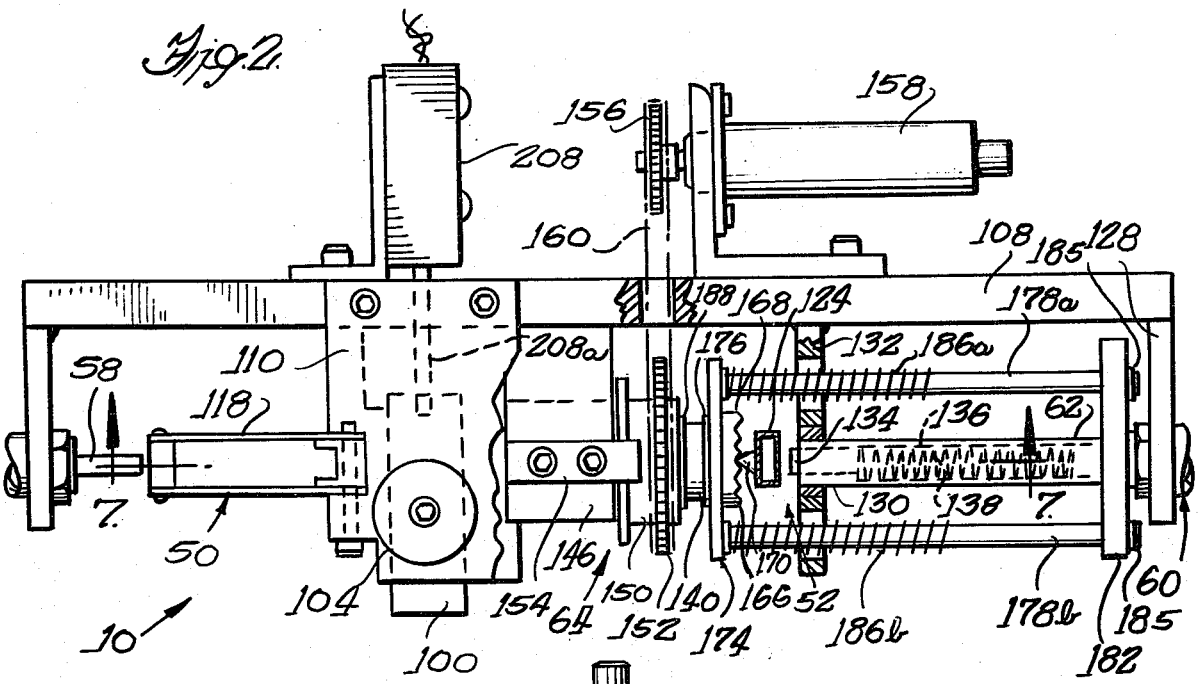
FIG. 2 is a fragmentary plan view of the apparatus of FIG. 1, portions being broken away for clarity.
Figure 3:
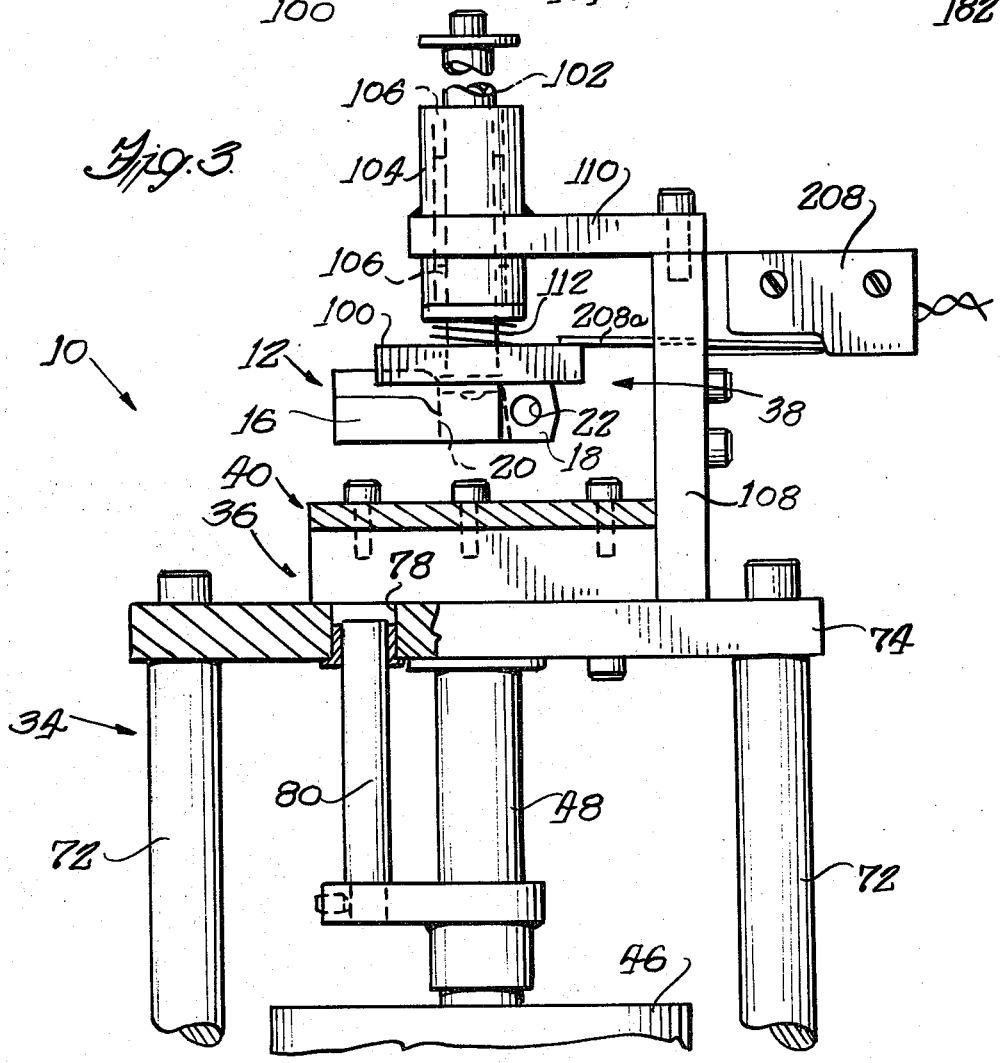
FIG. 3 is a transverse sectional view taken substantially along line 3—3 of FIG. 1, looking in the direction of the arrows.

Referring now to the drawings, and in particular to FIGS. 1-3, apparatus for trimming a cable terminal lug to a predetermined size, inserting a bolt through a bore in the lug and assembling a nut onto the bolt in a single operating cycle is indicated generally at 10. A cable terminal lug of the type with which the apparatus 10 finds application is illustrated, for purposes of example only, in FIG. 4 and is indicated generally at 12. The cable terminal lug 12 may be made from a suitable die castable metallic material such as lead alloy and is die-cast on the bared end of a length of insulated electrical conductor cable 14.

The terminal lug 12 is formed with a connector end 16 adapted to be firmly crimped around the bared end of the conductor 14 to assure both mechanical and electrical connection and strength. The connector end 16 is formed integral with a bifurcated end 18 which defines a first substantially cylindrical bore 20 adapted to receive a battery post or the like therethrough to which the terminal lug 12 is to be secured. The bifurcated end 18 has a second bore 22 formed therethrough the axis of which is spaced from and generally transverse to the axis of bore 20. The bore 22 is adapted to receive a threaded bolt 24 therethrough such that the head **24*a* of the bolt abuts a recess surface 18*a* on the terminal lug while the opposite end of the bolt is adapted to receive a nut 26 in threaded engagement thereon. The bolt 24 and associated nut 26** facilitate clamping of the terminal lug onto a battery post or the like as is known.

Figures 4, 5, 6, 7:
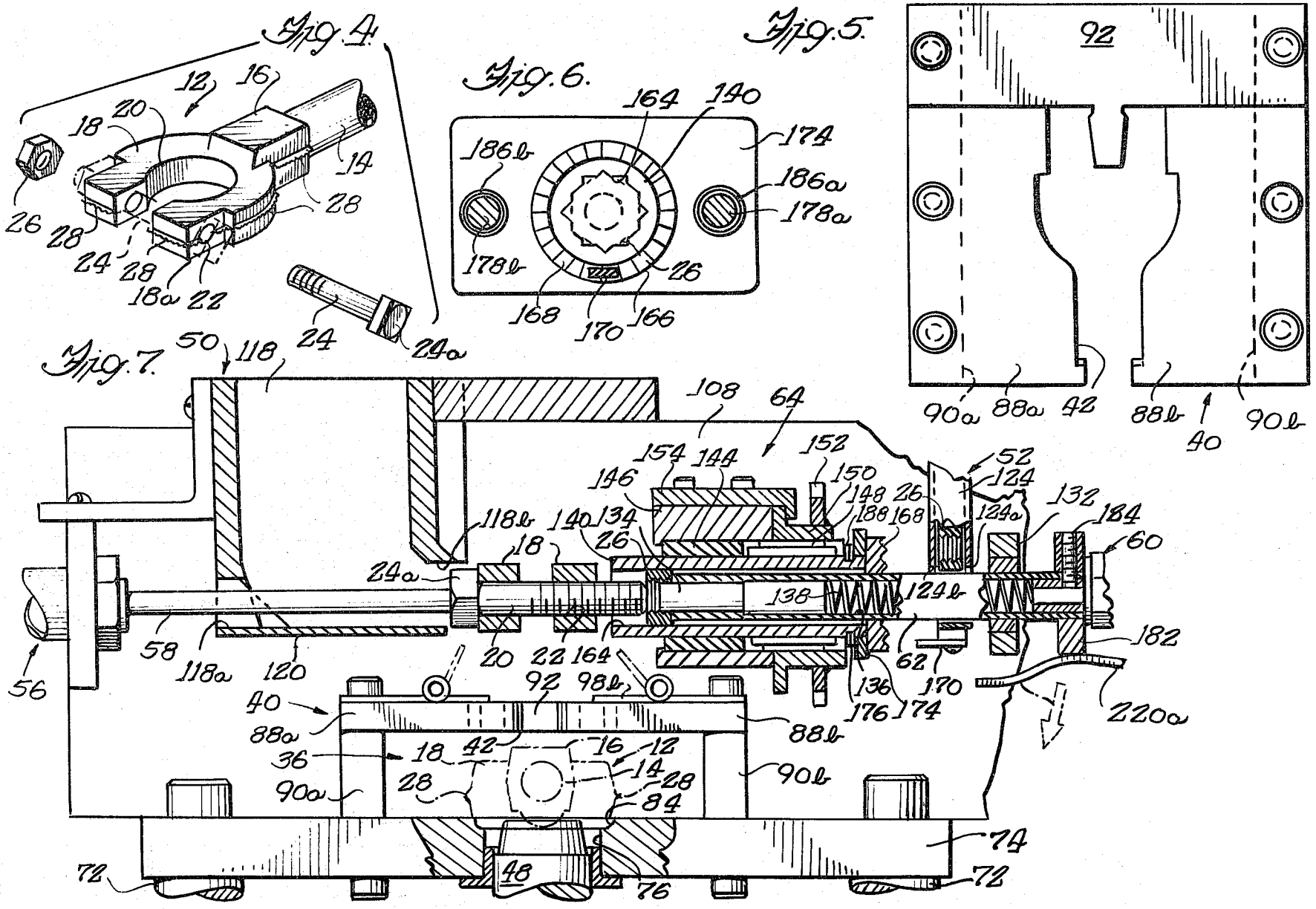
FIG. 4 is a perspective view illustrating a cable terminal lug of the type to be trimmed and have a bolt and nut assembled thereon in accordance with the apparatus of the present invention.
FIG. 5 is a fragmentary sectional view taken substantially along line 5—5 of FIG. 1 and illustrating the trim die plates.
FIG. 6 is a fragmentary transverse sectional view, on an enlarged scale, taken substantially along line 6—6 of FIG. 1.
FIG. 7 is a fragmentary elevational view, partly in longitudinal section, of the apparatus of FIG. 1 but showing a bolt inserted through the terminal lug and a nut disposed in position to be applied on the bolt.

In manufacturing the die-cast cable terminal lugs 12, a flashing or fin-like ridge or projection, such as indicated at 28 in FIG. 4, may be formed on the terminal lug along the outer surface thereof at the median plane of the lug. Such fin-like ridge 28 is generally formed at the interface or parting plane of two die mold sections when forming the terminal lug and must be removed to prevent injury to an operator during handling of a terminal lug.

The apparatus 10 is adapted to trim the fin-like ridge 28 from the terminal lug 12 and in the same operating cycle also insert a bolt 24 through the bore 22 and assemble a nut 26 onto the threaded shank end of the bolt. Very generally, the apparatus 10 includes base means 34 which defines a first station 36 adapted to receive a cable terminal lug 12 therein preparatory to trimming the lug, and a second station 38 to which the terminal lug 12 is moved for assembly of a bolt 24 and nut 26 within the bore 22. Trim die means 40 are supported by the base means 34 intermediate the first and second stations and define a shearing edge 42 of predetermined plan configuration operative to trim the fin-like ridge 28 from the terminal lug 12 as it is moved from the first to the second station.

An actuating cylinder 46 is mounted on the base means and is operative to extend a piston 48 for cooperation with a terminal lug 12 disposed within the first station 36 to move the terminal lug to the second station 38 during which the lug cooperates with the trim die means 40 to trim the terminal lug to the predetermined plan configuration of the shearing edge 42.

First supply means, indicated generally at 50, is operative to sequentially supply bolts 24 to the second station 38 such that the axis of an advanced bolt is axially aligned with the bore 22 within a terminal lug 12 disposed at the second station 38. Second supply means, indicated generally at 52, is operative to sequentially supply nuts 26 to the second operating station 38 such that each advanced nut is substantially axially aligned with a bolt 24 supplied to the second station 38, and thus is axially aligned with the bore 22 of a terminal lug disposed at the second station.

First fluid pressure operated means in the form of a fluid pressure operated cylinder or ram 56 is cooperable with the bolt supply means 50 and includes a piston 58 operable to move a bolt 24 from the supply means 50 to a position wherein the threaded shank of the bolt passes through the bore 22 in the terminal lug 12 disposed at the second station 38. Second fluid pressure operated means in the form of a fluid pressure operated cylinder or ram 60 is cooperable with the nut supply means 52 and includes an extendible piston 62 operative to advance a nut 26 from the supply means 52 to a position axially aligned with and juxtaposed to the threaded end of a bolt 24 inserted through the bore 22 in a terminal lug 12 disposed in the second operating station.

Rotational drive means 64 are mounted on the base means 34 and are adapted for cooperation with a nut from the supply means 52 to guide the nut to an axially aligned position with a bolt disposed within the bore 22 of the terminal lug and simultaneously rotate the nut to effect threaded engagement thereof with the threaded shank of the bolt to a predetermined torque. As will become more apparent hereinbelow, the apparatus 10 includes a control circuit operative to effect movement of the various operating pistons 48, 58 and 62 and rotation of the rotary drive means 64 in predetermined relation so that an untrimmed cable terminal lug 12 inserted into the first station 36 of the apparatus is automatically moved to a second position during which the lug is trimmed, and after which a bolt 24 and nut 26 are assembled onto the terminal lug.

Turning now to a more detailed description of the apparatus 10, the base means 34 includes a base plate 70 on which the actuating cylinder 46 and four upstanding support rods 72 are mounted. A support plate or platform 74 is mounted on the upper ends of the support rods 72 and has a pair of cylindrical bores 76 and 78 positioned to receive the piston 48 and a guide shaft 80 therethrough, respectively. Suitable guide bushings are interposed between the piston 48 and its associated bore 76, and between the guide shaft 80 and its associated bore 78.

The upper surface of the support plate 74 has a recess 84 formed therein adapted to receive and initially position a cable terminal lug 12 in predetermined relation to the bore 76 so that an upper tapered end **48*a* of the piston 48 is partially received within the bore 20 of the terminal lug when placed within the recess 84, as shown in FIG. 1. In this manner, upward movement of the piston 48 is operative to move the lug upwardly from the first station 36 to the second station 38**.

Referring particularly to FIG. 5, taken in conjunction with FIGS. 1 and 3, the trim die means 40 includes a pair of symmetrical die plates **88*a* and 88*b* supported on a pair of parallel support bars 90*a* and 90*b* so as to be spaced above a terminal lug 12 when positioned within the recess 84. The die plates 88*a*, *b* are symmetrical about a plane containing the axis of the piston 48 and transverse to the longitudinal axis of the support plate 84. A third trim die plate 92 is similarly supported on the support bars 90*a*, *b* for planar cooperation with the die plates 88*a*, *b* to define a substantially continuous shear edge 42 having a plan configuration, as considered in FIG. 5, suitable to shear off the fin-like projection 28 on a terminal lug 12** during upward movement of the terminal lug through the opening internally of the trim die plates.

A pair of hinge members **98*a* and 98*b* are mounted on the upper surfaces of the laterally spaced die plates 88*a*, *b*, respectively, so that hinge leaves overlie the opening within the die plates and are pivoted upwardly upon passage of a terminal lug 12 through the trim die plates, after which the hinge leaves return to positions preventing downward movement of the terminal lug through the trim dies. The hinge members 98*a*, *b* thus facilitate withdrawal of a finished terminal lug after trimming and assembly of a bolt and nut within the bore 22**.

The second station 38 of the apparatus 10 is defined by a stop bar 100 mounted on the lower end of a vertical support shaft 102 which is supported by and axially movable within a tubular housing 104 and associated bushings 106. The housing 104 is mounted on an upstanding frame plate 108 through a support bracket 110 such that the axis of the support shaft 102 is generally axially aligned with the bore 20 of a terminal lug 12 being raised to the second station 38. The lower surface of the stop bar 100 is preferably recessed to receive the upper surface of a raised terminal lug in nested relation therein. A coil compression spring 112 is interposed between the lower end of the housing 104 and the stop bar 100 to urge the stop bar to a position disposed slightly below the position of the stop bar shown in FIGS. 1 and 3 so that upward movement of a terminal lug 12 upon extension of the piston 48 effects engagement of the terminal lug with the stop bar 100 and moves it slightly upwardly to a position wherein the bore 22 in the lug is axially aligned with the pistons 58 and 62.

After a terminal lug 12 is moved upwardly through the trim die means 40 and engages the stop bar 100, the fluid pressure operated cylinder 56 is a single acting pneumatic cylinder and operates to extend the piston 58 and insert a bolt 24 through the bore 22 in the terminal lug. For this purpose, the apparatus 10 is adapted to receive sequentially arranged bolts 24 from a bolt feeding apparatus (not shown) of known design operative to deposit bolts into a bolt receiving cartridge 118 defining the first supply means 50. The bolt receiving cartridge 118 has a bottom wall 120 to which each successive bolt 24 moves by gravity such that its axis is preferably axially aligned with the axis of the piston 58. The bolt receiving cartridge 118 is open at 118*a* to allow passage of the piston 58 therethrough and is also open at 118*b* to facilitate passage of a bolt from the cartridge into the bore 22 of a terminal lug when disposed at the second station 38, as best seen in FIG. 7.

Coincident with insertion of a bolt 24 through the bore 22 of a terminal lug 12 disposed at the second station 38, a nut 26 is fed from the nut supply means 52 to a position to be threaded onto the threaded shank end of the bolt. The nut supply means 52 is of known design and includes a feed track 124 adapted to receive hexagonal shaped nuts 26 from a source (not shown) and sequentially deliver the nuts in predetermined rotational orientation to a position axially aligned with the piston 62. The feed track 124 is open on its lower end at 124*a* and 124*b* to facilitate passage of the piston 62 therethrough to pick up and advance a nut from the feed track into the rotational drive means 64.

As best seen in FIGS. 1, 2 and 7, the second fluid pressure operated cylinder 60, which comprises a single acting pneumatic cylinder, is mounted on a bracket 128 fixed to the upstanding frame plate 108. The piston 62 extends forwardly from the bracket 128 through an annular sleeve bearing 130 supported within a bracket 132 secured to the upstanding frame plate 108. The piston 62 carries a nut pickup nib 134 within a suitable bore 136 in the piston, the nib 134 being biased axially outwardly from the bore 136 by a compression spring 138. The nib 134 is adapted to enter the threaded bore of a nut 26 disposed at the lower end of the feed track 124 upon forward movement of the piston 62 so as to advance the lowermost nut into a feed tube 140 which forms a part of the rotational drive means 64.

The feed tube 140 is supported by an annular sleeve bearing 144 for longitudinal and rotational movement relative to the sleeve bearing. The sleeve bearing 144 is mounted within a support block 146 secured to the upstanding frame plate 108 such that the axis of the feed tube 140 is coaxial with the axes of the piston 62 and the bore 22 of a terminal lug 12 disposed in the second station 38. A unidirectional roller clutch 148 of known design is mounted on the feed tube 140 internally of an annular drive sleeve 150 having a drive sprocket 152 thereon. The drive sleeve 150 and associated sprocket 152 are maintained in fixed axial relation on the clutch 148 by a bracket 154 mounted on the support block 146, as best seen in FIG. 7. The drive sprocket 152 has driving connection with a drive sprocket 156 on the drive shaft of an air drive motor 158 through a drive chain 160 so that operation of the drive motor 158 effects rotation of the feed tube 140 in a direction to effect threaded engagement of a nut 26 disposed within the feed tube onto the threaded end of a bolt 24 inserted within the bore 22 of a terminal lug 12 disposed at the station 38.

The feed tube 140 has a polygonal internal bore 164 therethrough which, in the illustrated embodiment, takes the form of a twelve point polygon as shown in FIG. 6. The polygonal bore 164 is adapted to receive and effect positive engagement with a nut 26 inserted therein so as to facilitate rotation of the nut. To insure proper registration of the polygonal bore 164 with a hexagonal nut 24 as the nut is fed into the bore from the lower end of the feed track 124, a registration ring 166 is secured on the end of the feed tube 140 facing the nut feed track. The registration ring has a serrated end surface 168 defining twelve V-shaped recesses circumferentially spaced about the registration ring. The V-shaped recesses are disposed in predetermined relation to the internal twelve point polygonal bore 164 and are cooperable with a pointed arm 170 secured to the lower end of the feed track 124 to establish predetermined registration of the feed tube with the discharge end of the feed track. During operation of the apparatus 10, the feed tube 140 is moved longitudinally between a first outer position adjacent the lower end of the feed track 124, as shown in FIGS. 1 and 2, and an inward position wherein the inner end of the feed tube coaxially overlies a portion of the end of a bolt 24 upon which a nut is to be threaded. After threading a nut onto the bolt, the feed tube 140 is returned to its outer position at which time the pointed arm 170 engages the serrated end surface 168 and effects slight rotation of the feed tube, if necessary, to facilitate entry of the pointed arm 170 into one of the V-shaped recesses and thereby establish the desired registration between the bore 164 and the discharge end of the feed track 124.

Longitudinal reciprocal movement of the feed tube 140 is effected by the piston 62 of the pneumatic actuating cylinder 60. To this end, the feed tube 140 has a bracket 174 mounted thereon between the registration ring 168 and a retainer ring 176 so that the feed tube is rotatable relative to the bracket 174. A pair of parallel rods 178*a* and 178*b* are secured to the bracket 174 and extend through suitable openings in the bracket 132 parallel to the actuating piston 62. The ends of the rods 178*a, b* opposite the bracket 174 are slidable through suitable bores in an actuating bar 182 fixed on the piston 62 through suitable means such as a set screw 184. A retainer ring 185 is mounted on each of the rods 178*a, b* to prevent withdrawal of the rods 178*a, b* from the actuating bar 182 while allowing sliding movement of the actuating bar along the rods.

Identical coil springs 186*a* and 186*b* are mounted coaxially on the rods 178*a, b*, respectively, and are preferably secured to the bracket 174 as shown in FIG. 2. The coil springs 186*a, b* are selected to establish a lost motion connection between the actuating bar 182 and the bracket plate 174 during initial extension of the piston 62 from its cylinder 60 so that the nib 134 on the piston passes through the bore of the bottom nut 26 in the feed track 124 and advances the nut through the feed tube 120 to a position proximate the left-hand end of the feed tube, as considered in FIG. 7, without moving the bracket 174 and feed tube longitudinally. When the piston 62 has been extended a predetermined distance into the feed tube 140, the actuating bar 182 engages the free ends of the springs 186*a, b* and moves the feed tube 140 to a position wherein the retaining ring 176 engages an annular retaining ring 188 on the feed tube. As aforementioned, in this advanced position the inner end of the feed tube coaxially overlies a portion of the exposed threaded end of a bolt 24 inserted through the bore 22 in a terminal lug 12 disposed at the second station 38.

After threading a nut 26 onto a bolt inserted through the terminal lug bore 20, air pressure to the actuating cylinder 60 is reduced sufficiently to allow retraction of the piston 62 to its position as shown in FIGS. 1 and 2 by conventional means (not shown) internally of the cylinder 60. Such retraction of the piston 62 effects a corresponding retraction of the actuating bar 182 which engages the retainer rings 185 on the rods 178*a, b* to return the feed tube 140 to a position wherein the pointer arm 170 engages the registration ring 168 and establishes proper registration of the feed tube preparatory to advance of the next successive nut 26 in the feed track 124.

Having thus described the various structural elements of the apparatus 10, its manner of operation may best be understood by reference to FIGS. 8 and 9 which show schematic pneumatic and electrical circuits, respectively, for effecting semi-automatic operation of the apparatus 10. It is seen from the schematic diagram of FIG. 8 that the cylinder 46 is connected to a suitable source (not shown) of air pressure, such as 100 psi, through a manually operable pneumatic control valve 190, a solenoid operated system supply valve 192 and an air filter 194. The flow control valve 190 is connected in circuit with the base end of the cylinder 46 through a conventional flow control valve 196 and lubricator 198 to facilitate extension of piston 48. The upper end of the cylinder 46 is connected in circuit with the control valve 190 through a pair of conventional flow control valves 200 and 202 adapted to control the rate of extension and retraction of the piston 48 for a given system air pressure.

The coil of solenoid valve 192 is connected in electrical circuit with a manual electrical on-off switch 204 connected to a suitable 115 VAC power source, as best seen in FIG. 9. An indicator light 206 may also be connected in circuit with the switch 204 to indicate electrical power "on".

With a cable terminal lug 12 disposed within station 36 preparatory to trimming, manual operation of the control lever 190*a* of the control valve 190 so as to position the valve spool to introduce air pressure into the lower end of the cylinder 46 effects upward movement of the piston and associated cable terminal lug through the trimming dies 88*a*, 88*b* and 92 during which any fin-like projections 28 on the terminal lug are trimmed off by the shear edge 42. The piston 48 continues upward movement so that the trimmed terminal lug engages the stop bar 100 to actuate a contact arm 208*a* of a normally open switch 208 connected in series with a relay coil 210. Energizing the relay coil 210 closes a pair of normally open contacts 210*a* to energize and open a normally closed solenoid valve 212 and pressurize the pneumatic cylinders 56 and 60 to extend their corresponding pistons 58 and 62, respectively. Suitable flow control valves 214*a* and 214*b*, pressure relief valves 216*a* and 216*b*, and lubricators 218*a* and 218*b* are connected in the fluid pressure lines to the cylinders 56 and 60 to control the rate of extension of their respective pistons, as is known.

Pressurizing the cylinder 56 to extend its piston 58 serves to feed a bolt 24 into the bore 22 of the terminal lug 12 positioned against the stop bar 100, while simultaneous pressurization of cylinder 60 to extend its piston 62 advances the lowermost nut 26 from the feed track into the feed tube 140. When the piston 62 has advanced a nut 26 to a predetermined position within the feed tube 140, such as generally adjacent the inner or left-hand end of the feed tube, as considered in FIG. 7, the actuating bar 182 engages the springs 186*a, b* and moves the feed tube 140 to a position wherein its inner end is disposed coaxially over the end of the bolt 24 disposed within the terminal lug bore 20. When the piston 62 has advanced the nut 26 and feed tube 140 to predetermined positions preparatory to assembling the nut onto the bolt, the actuating bar 182 engages an actuating arm 220*a* of a normally open switch 220 to energize a relay coil 222. Energizing the coil 222 closes its normally open contacts 222*a* to energize and open a normally closed solenoid valve 224 connected in the pneumatic circuit to the air motor 158. Opening the solenoid valve 224 effects driving rotation of the air motor 156 to rotate the feed tube 140 and thread the nut 26 onto the bolt 24 to a torque as established by the setting of a pressure relief valve 226 connected in the pressure line to the air motor. Preferably, the pressure relief valve 226 is set to effect a finger-tight torque of the nut onto the bolt. A lubricator 228 is also connected in the line to the air motor. Preferably, a safety switch 230 is connected in the control circuit to facilitate quick shutdown of the apparatus as may be necessary.

After a nut has been threaded onto a bolt within a terminal lug disposed within the second station 38 to a predetermined torque, which event may be recognized by the operator from the audible release of air by the pressure relief valve 226, the operator manually actuates the control lever 190*a* of the control valve 190 to return the valve spool to a position as shown in FIG. 8 and thereby connect the upper end of the cylinder 46 to the fluid pressure source, and the lower end to atmosphere so as to retract the piston 48 preparatory to the next operating cycle. As piston 48 is retracted, the stop bar 100 releases switch arm 208*a* to open switch 208 and deenergize coil 210 to open contacts 210*a* whereupon solenoid valve 212 is deenergized to effect retraction of the pistons 58 and 62. As piston 62 is retracted, the feed tube 140 is returned to its outer position and switch 220 reverts to its open condition to open relay contacts 222*a* and deenergize solenoid 224 which cuts off the air supply to air motor 158. Return of the feed tube 140 to its outer position releases the nut 26 and bolt 24 to allow the trimmed terminal lug to be lowered and withdrawn from the apparatus 10. The closed hinge members 98*a, b* prevent the finished lug from passing downwardly into the opening internally of the trim dies and thereby facilitate withdrawal of the assembled cable terminal lug.

Thus, in accordance with the present invention, it is seen that an apparatus is provided for trimming a cable terminal lug and assembling a bolt and nut thereon in a continuous operation. The apparatus provides significant economic advances over the prior art devices which required a first operation during which trimming of a cable terminal lug is effected and a second operation during which a bolt and nut are assembled onto the cable terminal lug.

While a preferred embodiment of the present invention has been illustrated and described, it will be understood to those skilled in the art that changes and modifications may be made therein without departing from the invention in its broader aspects.

Various features of the invention are defined in the following claims.

What is claimed is:

1. Apparatus for trimming a cable terminal lug to a predetermined size, inserting a bolt through a bore in the lug and applying a nut to the bolt, said terminal lug defining a first bore therethrough adapted to receive a battery post or the like therein, and having a second bore spaced from and generally transverse to the axis of said first bore and adapted to receive said bolt therethrough, said machine comprising, in combination, base means defining first and second stations, said first station being adapted to receive a cable terminal lug therein with said first bore disposed in predetermined position, trim die means supported by said base means and defining a shearing edge of predetermined configuration, means cooperable with said terminal lug when received within said first station to move said lug to said second station during which said lug cooperates with said trim die means to trim said lug to said predetermined configuration, first supply means for sequentially supplying bolts to said second station with the axes of said bolts substantially axially aligned with said second bore of a terminal lug when disposed at said second station, second supply means operative to sequentially supply nuts to said second station, first means cooperable with said first supply means and operable to move a bolt from said first supply means to a position wherein a threaded shank of the bolt passes through said second bore in said terminal lug, second means cooperable with said second supply means and operative to advance a nut from said second supply means to a position substantially axially aligned with and juxtaposed to the end of a threaded shank inserted through said second bore, and means for effecting rotation of said advanced nut in a direction to effect threaded engagement thereof with the threaded shank of said bolt.

2. Apparatus as defined in claim 1 wherein said trim die means is supported by said base means so as to lie in a plane generally normal to the axis of said first bore of a terminal lug when inserted within said first station in said predetermined position, said means cooperable with said terminal lug to move said lug to said second position being operative to move said lug in a direction substantially normal to the plane of said trim die means.

3. Apparatus as defined in claim 2 wherein said means cooperable with said terminal lug to move said lug to said second station includes a fluid pressure operated actuator disposed for axial alignment with said first bore of said terminal lug when disposed within said first station.

4. Apparatus as defined in claim 3 wherein said fluid pressure operated actuator is adapted to effect movement of said terminal lug through said trim die means so as to shear flashing or the like from said terminal lug to trim said terminal lug to said predetermined configuration.

5. Apparatus as defined in claim 1 wherein said first means operable to move a bolt from said first supply means through said second bore in said terminal lug includes a fluid pressure operated actuator, said second means operative to advance a nut from said second supply means to a position axially aligned with and juxtaposed to the end of the threaded shank of a bolt inserted through said second bore including a second fluid pressure operated actuator, and including control means operatively associated with said first and second fluid pressure operated actuators to initiate actuation of said first and second fluid pressure operated actuators after a terminal lug is moved to said second station.

6. Apparatus as defined in claim 5 wherein said means for effecting rotation of said advanced nut in a direction to effect threaded engagement thereof with said bolt is adapted to apply said nut onto said bolt to a predetermined torque.

7. Apparatus as defined in claim 1 wherein said means for effecting rotation of said advanced nut to effect threaded engagement thereof with the threaded shank of said bolt includes a feed tube adapted to receive said nut therein and guide nut to said position juxtaposed to the end of said threaded shank of said bolt, and drive means operatively associated with said feed tube and adapted to effect rotation thereof in said direction to effect threaded engagement of said advanced nut with said bolt.

8. Apparatus as defined in claim 7 wherein said means for effecting rotation of said advanced nut to effect threaded engagement thereof with the threaded shank of said bolt includes unidirectional drive means.

9. Apparatus as defined in claim 7 wherein said nut has a polygonal circumferential configuration, said feed tube having an internal bore having a polygonal configuration adapted to receive said polygonal shaped nut therein in driving rotation therewith, said feed tube and said second supply means having mutually cooperable means thereon adapted to effect predetermined registration of said feed tube with said second supply means so that a nut advanced from said second supply means is readily received within said polygonal bore in said feed tube.

10. Apparatus as defined in any one of claims 7 or 9 wherein said feed tube is mounted for longitudinal movement between a first position spaced from the threaded shank end of a bolt inserted within said second bore, and a second position wherein said threaded shank end of a bolt disposed within said second bore is coaxial within said drive tube, said second means cooperable with said second supply means to advance a nut also being cooperable with said feed tube to effect movement thereof between its said first and second positions.

11. Apparatus as defined in claim 1 including means cooperative with said trim die means to facilitate movement of a cable terminal lug through said trim die means in a first direction but preventing a reverse movement of said terminal lug through said trim die means.

* * * * *

UNITED STATES PATENT AND TRADEMARK OFFICE

CERTIFICATE OF CORRECTION

PATENT NO. : 4,166,311

DATED : September 4, 1979

INVENTOR(S) : Douglas K. Lindstrand

It is certified that error appears in the above-identified patent and that said Letters Patent are hereby corrected as shown below:

Column 1, line 8, after "trimming" insert --a--.

Column 10, line 16, after "guide" insert --said--.

Signed and Sealed this

*Fifth* Day of *February 1980*

[SEAL]

*Attest:*

SIDNEY A. DIAMOND

*Attesting Officer*

*Commissioner of Patents and Trademarks*